US006263171B1

(12) United States Patent
Oyamada

(10) Patent No.: US 6,263,171 B1
(45) Date of Patent: Jul. 17, 2001

(54) INK DENSITY ADJUSTING MECHANISM AND ELECTROPHOTOGRAPHIC APPARATUS USING THE INK DENSITY ADJUSTING MECHANISM

(75) Inventor: Satoru Oyamada, Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/624,344

(22) Filed: Jul. 24, 2000

(30) Foreign Application Priority Data

Aug. 3, 1999 (JP) ..... 11-219497

(51) Int. Cl.[7] ..... G03G 15/10
(52) U.S. Cl. ..... 399/57; 366/182.4; 399/237
(58) Field of Search ..... 399/57, 30, 58, 399/61, 62, 64, 237, 238; 366/136, 137, 182.3, 182.4

(56) References Cited

U.S. PATENT DOCUMENTS 4,671,309 * 6/1987 Iemura et al. ..... 399/57
6,170,977 * 1/2001 Yuakushji ..... 366/136

FOREIGN PATENT DOCUMENTS 8-314283 11/1996 (JP) .

* cited by examiner

*Primary Examiner*—Quana M. Grainger
(74) *Attorney, Agent, or Firm*—Young & Thompson

(57) ABSTRACT

In response to a print end instruction from a controller, a development controller checks if the ink density is proper. If the ink density is out of proper range, a circulation path switching valve is turned on to continue ink density adjustment processing even after printing ends. The ink circulation path is switched to allow the ink to flow directly to an ink tank. The ink stored in a supply path from the valve to a developing unit and in the developing unit is returned to the ink tank. In this state, the ink density adjustment processing is performed. A transmission type density sensor senses the current density of X %, and sends the density to the development controller. The development controller retrieves proper density range data of N %–M % from a density adjustment table and compares the sensed density with the proper density range data. If X %>M %, L ml of diluted ink solution is supplied by a supply pump. If X %<N %, K ml of ink dye is supplied by the supply pump.

12 Claims, 10 Drawing Sheets

INK DENSITY ADJUSTING MECHANISM AND ELECTROPHOTOGRAPHIC APPARATUS USING THE INK DENSITY ADJUSTING MECHANISM

BACKGROUND OF THE INVENTION

1. Field of the Invention

The present invention relates to an ink density adjusting mechanism and an electrophotographic apparatus using this ink density adjusting mechanism, and more particularly to an ink density adjusting mechanism for use in an electrophotographic process using liquid ink and an electrophotographic apparatus equipped with this ink density adjusting mechanism.

2. Description of the Related Art

Conventionally, a transmission-type sensor, with a light-emitting device and a light-receiving device as the density detecting means, has been used on an electrophotographic apparatus using liquid ink to keep the ink density at a constant level. This technology is disclosed, for example, in FIGS. 1–4 of Japanese Patent Laid-Open Publication No. Hei 8-314283.

To quickly start printing at a right density the next time printing is to start, it is an effective way to sense the ink density after printing and then adjust the ink density at a right density. A transmission type density sensor, though simple in circuit configuration, requires ink to be circulated for sensing the correct density. Circulating ink for density adjustment after printing, that is, at non-print time, means that ink must be supplied also to a developing unit and that stains are sometimes generated on a photo-sensitive medium on which images are to be developed.

As described above, the conventional ink density adjusting mechanism circulates ink at non-print time in order to adjust the density. One of the problems with this mechanism is that, because ink is circulated also to the developing unit, stains are sometimes generated on a photo-sensitive medium on which images are to be developed.

SUMMARY OF THE INVENTION

It is an object of the present invention to provide an ink density adjusting mechanism, which does not generate stains on a photo-sensitive medium on which images are to be developed even if ink is circulated at non-print time to adjust the density, and an electrophotographic apparatus using this ink density adjusting mechanism.

The electrophotographic apparatus according to the present invention, which uses liquid ink, has an ink density adjusting mechanism comprising a developing unit; an ink tank; a pump which circulates the ink in the ink tank; a valve which switches a circulation path of the ink between the circulation path supplying the ink to the developing unit and the circulation path bypassing the developing unit; and a density sensor which senses a density of the ink.

The ink density adjusting mechanism according to the present invention has a circulation path switching valve between the developing unit and the transmission type density sensor of the electrophotographic apparatus. This valve, when on, cuts off the ink flow path to the developing unit and circulates the ink through the ink tank to allow the ink to circulate without flowing it into the developing unit. Therefore, ink density adjustment, even if performed at non-print time, does not stain the photosensitive materials, thus making it possible to print at proper density any time and to eliminate an uneven density in a print image.

DETAILED DESCRIPTION OF THE PREFERRED EMBODIMENTS

Figure 1:
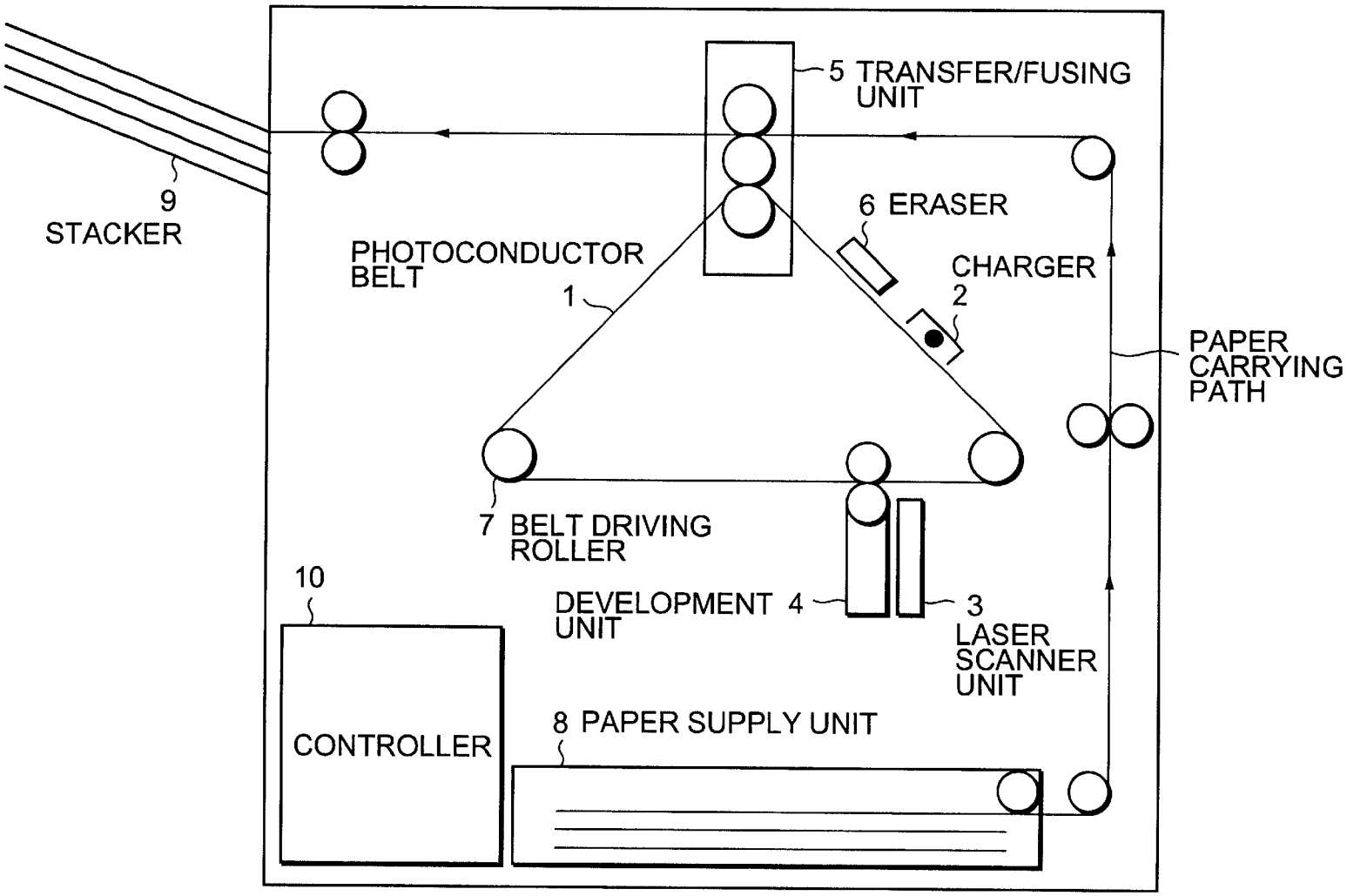
FIG. 1 is a diagram showing the overall configuration of a first embodiment.

Some embodiments of the present invention will be decribed in detail by referring to the attached drawings FIG. 1 is an overall configuration diagram of a first embodiment of the present invention. An electrophotographic apparatus forming an image using the electrophotographic process is used on units such as a copier, facsimile, and printer. FIG. 1 shows an example of printer.

A photoconductor belt 1 is a belt-shaped photosensitive material. A charger 2 charges the surface of the photoconductor belt 1. A laser scanner unit 3 directs a laser beam onto the photoconductor belt 1 to form a desired latent image on the photoconductor belt 1. This latent image is developed by a development unit 4 using developer. Liquid ink is used as the developer. This liquid ink includes ink dye and diluted ink solution. A transfer/fusing unit 5 transfers and fixes onto the paper the toner image formed on the photoconductor belt 1. A eraser 6 discharges the surface of the photoconductor belt 1 after the image is transferred. A belt driving roller 7, turned by a motor not shown in the figure, drives the photoconductor belt 1. Paper, supplied from a paper supply unit 8, is transported along a paper carrying path shown in the figure and ejected from a stacker 9 via the transfer/fusing unit 5. A controller 10 starts or ends the print operation on the electrophotographic apparatus and controls the units.

Figure 2:
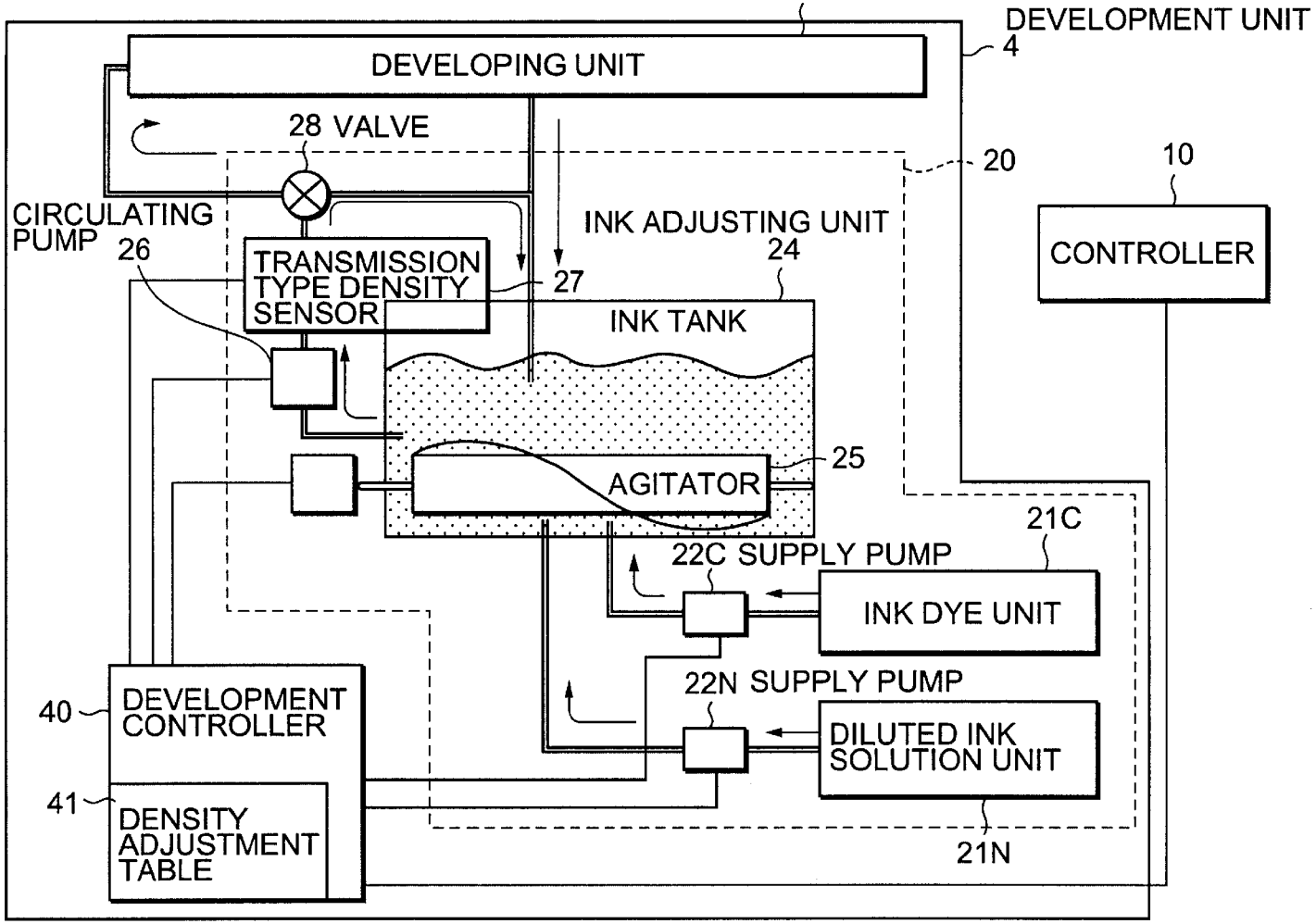
FIG. 2 is a block diagram showing the configuration of a development unit and a controller of the first embodiment.

FIG. 2 is a block diagram showing the configuration of the development unit 4 and the controller 10. The development unit 4 comprises an ink adjusting unit 20 which controls the ink agitation operation, ink circulation operation, and density adjusting operation, a developing unit 30 which receives ink from the ink adjusting unit 20 to form an image on the photoconductor belt 1, and a development controller 40 which controls the ink adjusting unit 20 and the developing unit 30 in response to a request from the controller 10.

The ink adjusting unit 20 comprises an ink dye unit 21C which supplies ink dye, a supply pump 22C which pumps the ink dye, a diluted ink solution unit 21N which supplies diluted ink solution, a supply pump 22N which pumps the diluted solution, an ink tank 24 in which proper-density ink is generated, an agitator 25 which agitates the ink, a circulating pump 26 which pumps ink to the developing unit 30, a transmission type density sensor 27 which senses the ink density, and a circulation path switching valve 28 which, when off, circulates ink around a path from the ink tank 24 to the developing unit 30 and which, when 5 on, closes the path to the developing unit 30 and circulates ink around a path only via the ink tank 24. The transmission type density sensor 27, which is always on the ink circulating path regardless of whether the circulation path switching valve 28 is on or off, receives light from the light emitting device via the light receiver to detect the ink density. For correct detection of the ink density, the transmission type density sensor 27 should be located between the ink tank 24 and the valve 28 and, more preferably, between the circulating pump 26 and the valve 28.

In response to a request from the controller 10, the development controller 40 controls the developing unit 30 as well as the ink agitation, ink circulation, and density adjustment of the ink adjusting unit 20. The development controller 40 also has a density adjustment table 41. The density adjustment table 41 contains supply amount data such as density comparison data or operation time data on the supply pumps 22C and 22N.

Figure 3:
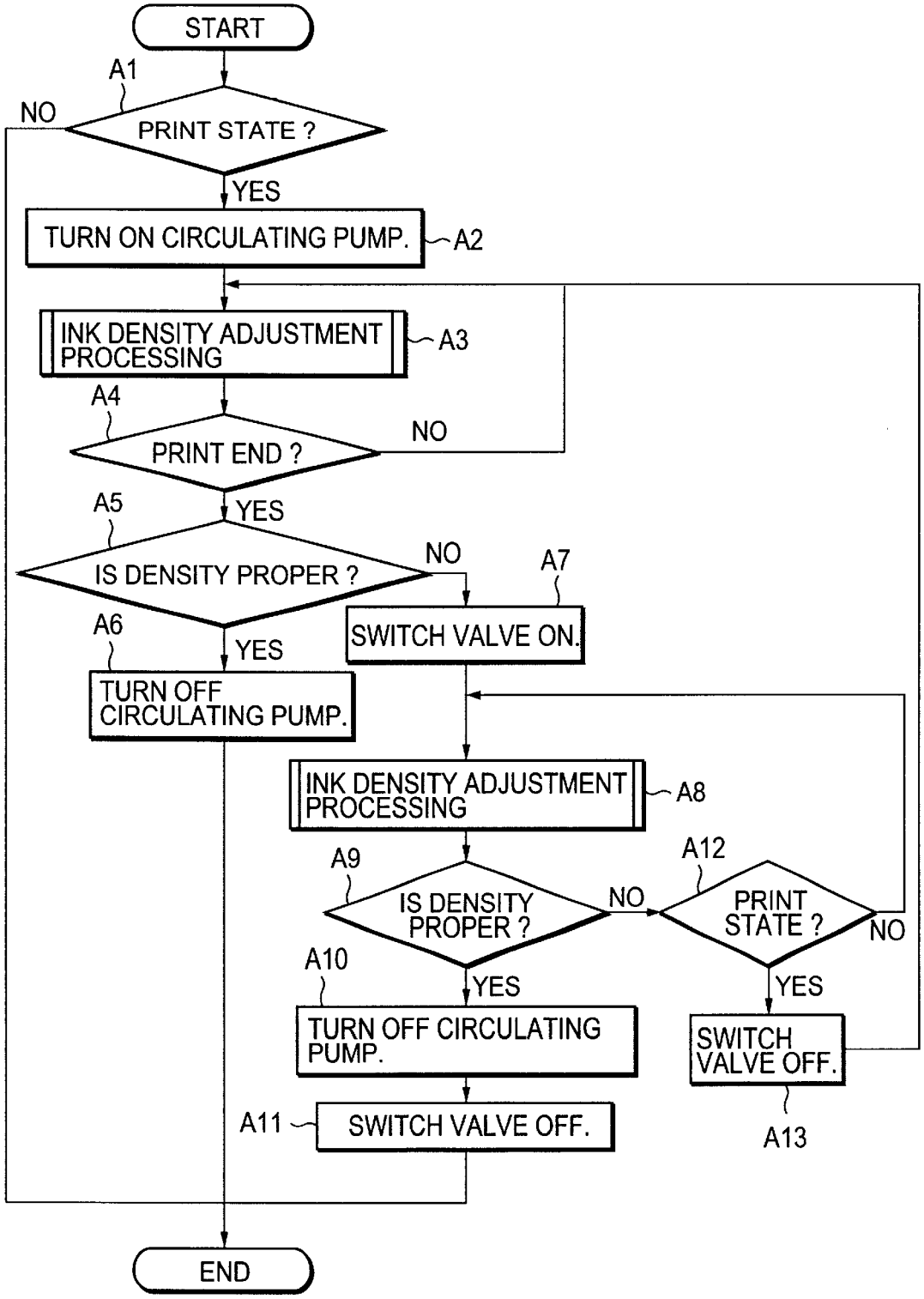
FIG. 3 is a flowchart showing the operation of the first embodiment.

Next, the operation will be described. FIG. 3 is a flowchart showing the operation of the first embodiment. In response to a request from the controller 10, the development controller 40 checks whether the electrophotographic apparatus is in the print state (step A1). If the apparatus is in the print state, the circulating pump 26 is turned on (step A2) to circulate ink and the ink density adjustment processing is performed (step A3) At this time, the valve 28 is turned off to allow the ink to be supplied from the ink tank 24 to the developing unit 30.

When the electrophotographic apparatus ends printing, a print end instruction is sent from the controller 10. The development controller 40 receives this print end instruction (step A4) and checks whether the current ink density is proper (step A5). If the checking result is within a proper range, the circulating pump 26 is turned off (step A6) and processing is terminated. If the checking result is out of the range, the circulation path switching valve 28 is turned on to continue ink density adjustment processing even after the end of printing (step A7). This prevents ink from being supplied from the ink tank 24 to the developing unit 30, and the electrophotographic apparatus enters the print end state. At this time, the ink stored in the supply path from the valve 28 to the developing unit 30 and in the developing unit 30 is returned to the ink tank 24. The ink circulation path is switched so that the ink flows from the valve 28 directly to the ink tank 24. Because the circulating pump 26 is still in operation, the transmission type density sensor 27 can sense the ink density and therefore the density may be adjusted.

In this state, ink density adjustment processing is performed (step A8). If the proper density is attained (step A9), the circulating pump 26 is turned off (step A10). In addition, the valve 28 is turned off to allow the ink to flow to the developing unit 30 (step A11), and then processing is terminated. If the proper density is not attained in step A9, a check is made to see if the electrophotographic apparatus is in the print state (step A12). If the apparatus is not in the print state, the ink density adjustment processing in step A8 is continued. If the apparatus is in the print state, the valve 28 is turned off (step A13) to allow the ink to be supplied from the ink tank 24 to the developing unit 30. Then, the ink density adjustment processing in step A3 is performed.

Figure 4:
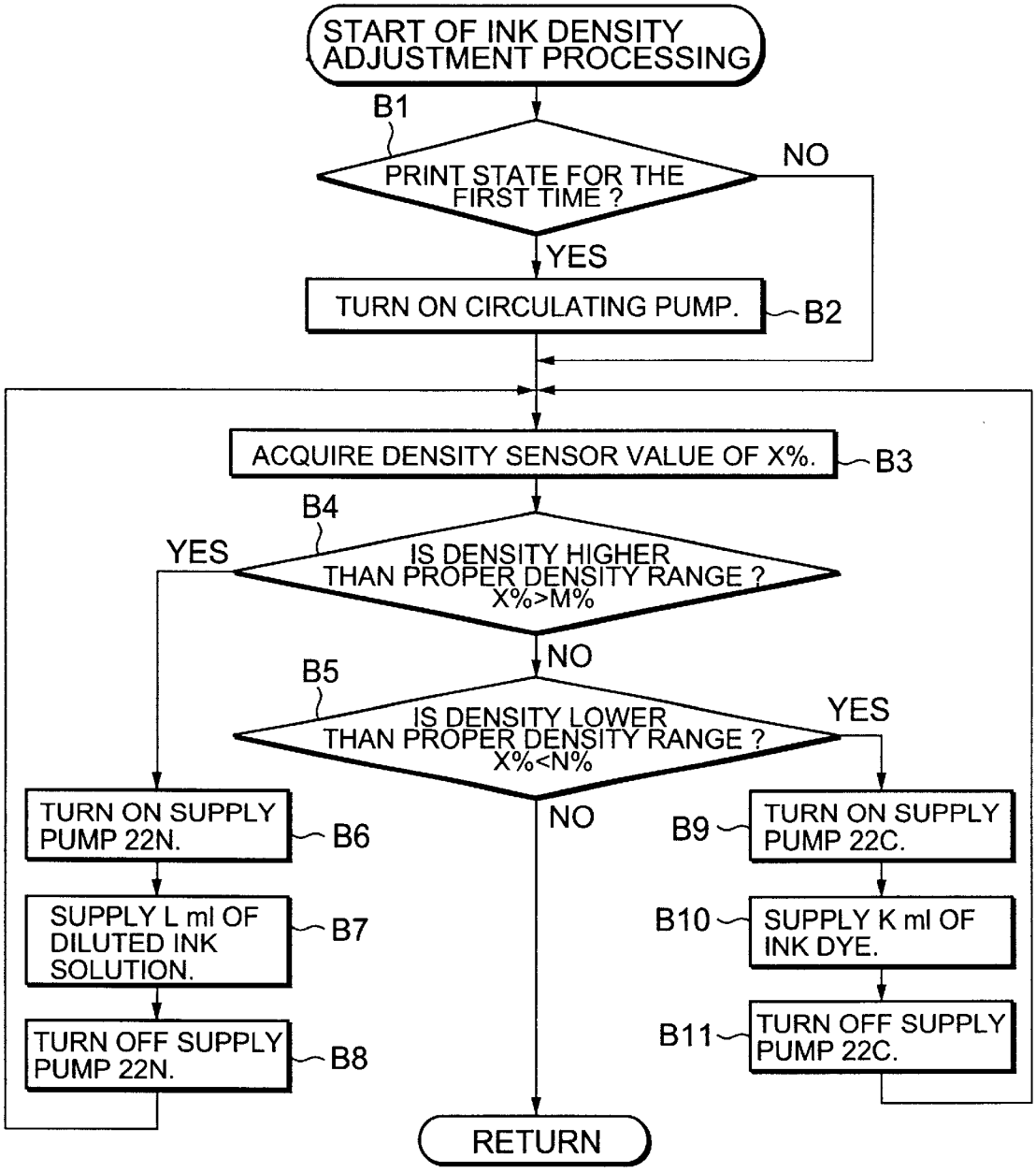
FIG. 4 is a flowchart showing the operation of the ink density adjustment processing of the first embodiment.

FIG. 4 is a flowchart showing how the ink density adjustment processing (steps A3 and A8 in FIG. 3) is performed. First, the development controller 40 checks if the density adjustment processing is performed for the first time. If so, the circulating pump 26 is turned on (step B1).

Next, the transmission type density sensor 27 acquires the current density represented as X % (step B3) and sends the acquired density to the development controller 40. To check if the current density X % is proper, the development controller 40 retrieves data from the density adjustment table 41 and compares the current density with the retrieved data (steps B4 and B5). The density adjustment table 41 contains proper density range N %–M %. If X %>M % in step B4, the supply pump 22N is started (step B6), Lml of diluted ink solution is supplied (step B7), the supply pump 22N is stopped (step B8), and then control is returned to step B3. If X %≦M % in step B4, control is passed to step B5. If X %<N % in step B5, the supply pump 22C is started (step B9), K ml of ink dye is supplied (step B10), the supply pump 22C is stopped (step B11), and then control is returned to step B3.

Steps B3 to B11 are repeated and, when the current density falls in the proper density range, processing is terminated.

As described above, in order to control the density adjustment processing, the transmission type density sensor 27 is used to measure the ink density of the ink in the ink tank 24. The development controller 40 checks if this measured density data is the target density. The adjustment data pre-stored in the density adjustment table 41 eliminates the need for complicated calculation and allows density adjustment to be made easily. The density adjustment amount data in the density adjustment table 41 is set smaller than the proper correction amount to allow the proper density to be attained in several adjustment operations. More correction cases, if stored in the table, enable finer adjustments to be made.

Figure 5:
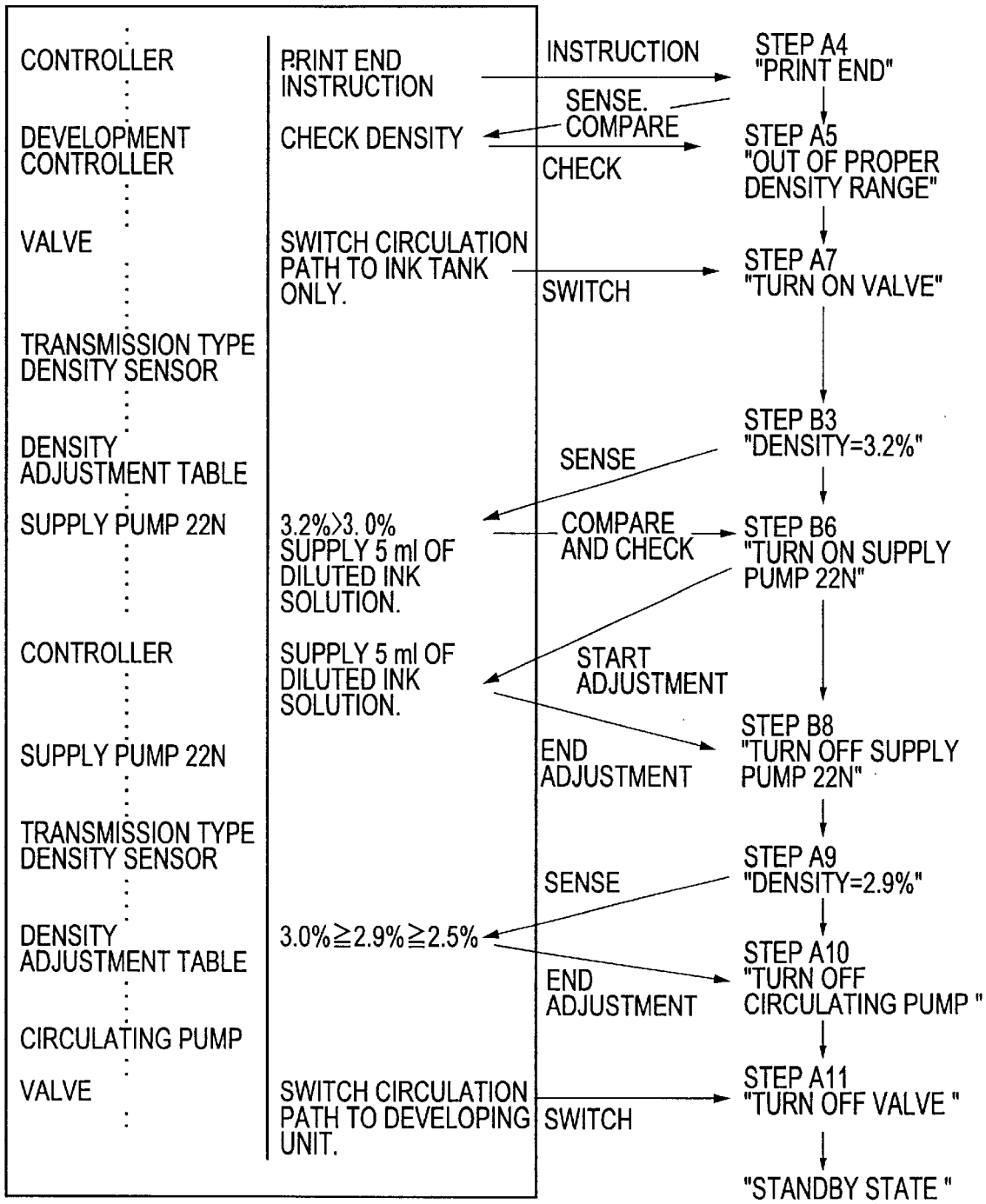
FIG. 5 is a diagram showing the operation of an example of the first embodiment.

Next, the operation of the embodiment of the present invention will be described using an example. FIG. 5 is a diagram showing the operation of the example. As shown in FIG. 5, assume that the current ink density X=3.2%, that the proper density ranges from 3.0% to 2.5%, that L=5 ml of diluted ink solution is supplied when the destiny exceeds 3.0%, and that K=2 ml of ink dye is supplied when the density is lower than 2.5%.

In response to a print end request from the controller 10, the development controller 40 turns on the valve 28 to prevent the ink from flowing into the developing unit 30 (steps A4–A7) because the current ink density is 3.2%. At this time, the ink stored in the ink supply path from the valve 28 to the developing unit 30 and in the developing unit 30 is returned to the ink tank 24. The circulating pump 26 is in operation and, therefore, the transmission type density sensor 27 senses the current density of 3.2%. The current density is compared with the proper density retrieved from the density adjustment table 41. Because the current density exceeds the proper density of 3.0%, 5 ml of diluted ink solution is supplied (steps B3–B8). Again, the transmission type density sensor 27 senses the adjusted density of 2.9%. This adjusted density is compared with the proper density. Because the adjusted density is within the range of the proper density, it is determined that adjustment has been finished (step A9). The circulating pump 26 is stopped, the valve 28 is turned off to allow the ink to flow to the developing unit 30, and then the adjustment processing is finished (steps A10, A11).

Figure 6:
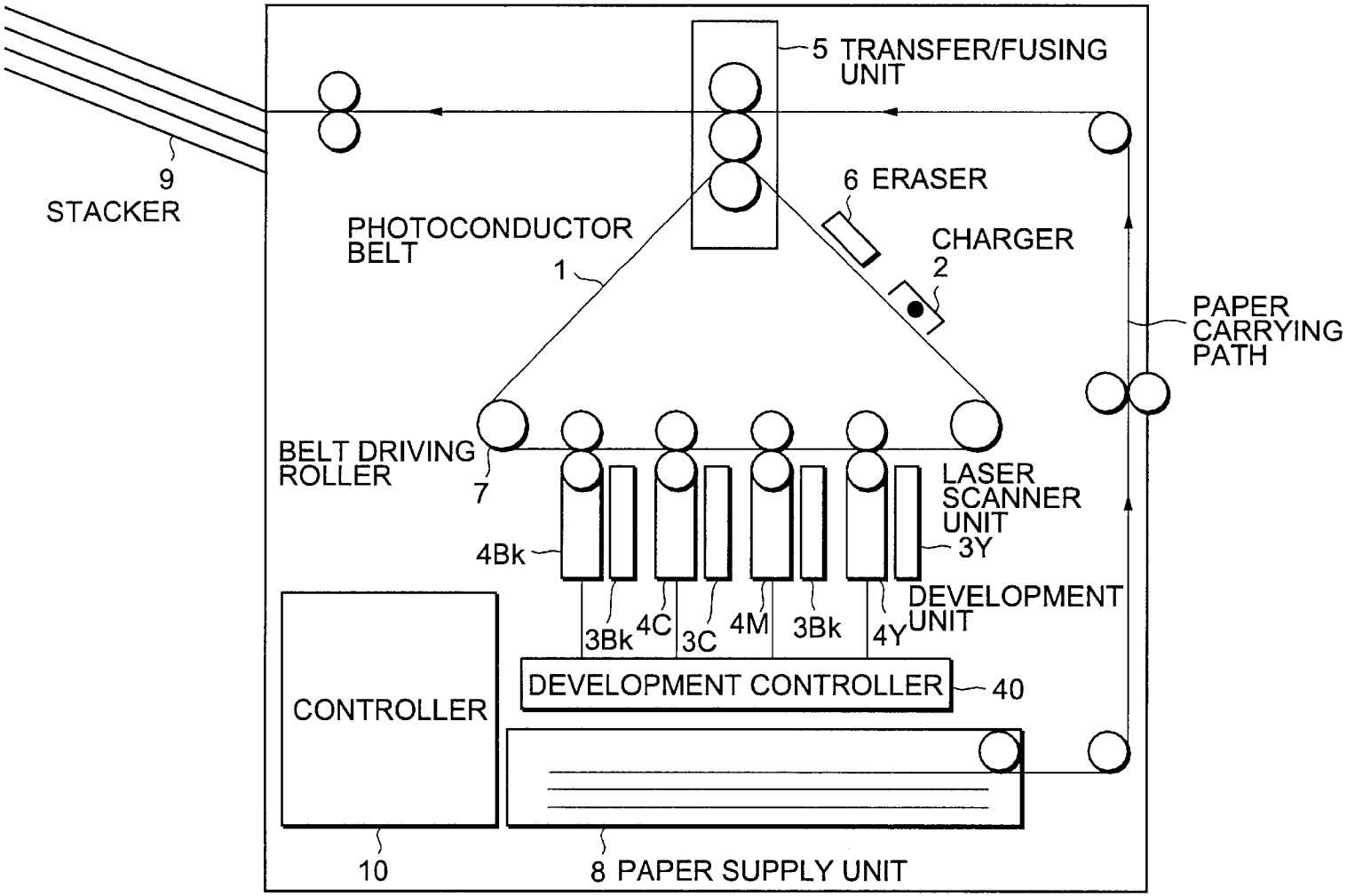
FIG. 6 is a diagram showing the overall configuration of a second embodiment.

Next, a second embodiment of the present invention will be described. FIG. 6 is an overall configuration diagram of the second embodiment. While one development unit is used in the first embodiment to develop one color, a plurality of development units are used in the second embodiment to develop a plurality of colors. In the example shown in FIG. 6, a full color image is formed using a yellow (Y) development unit 4Y, a magenta (M) development unit 4M, a cyan (C) development unit 4C, and a black (Bk) development unit 4Bk. To control these development units, a development controller 40 is provided. In addition, a yellow laser scanner unit 3Y, a magenta laser scanner unit 3M, a cyan laser scanner unit 3C, and a black laser scanner unit 3Bk are provided as exposure light sources.

Figure 7:
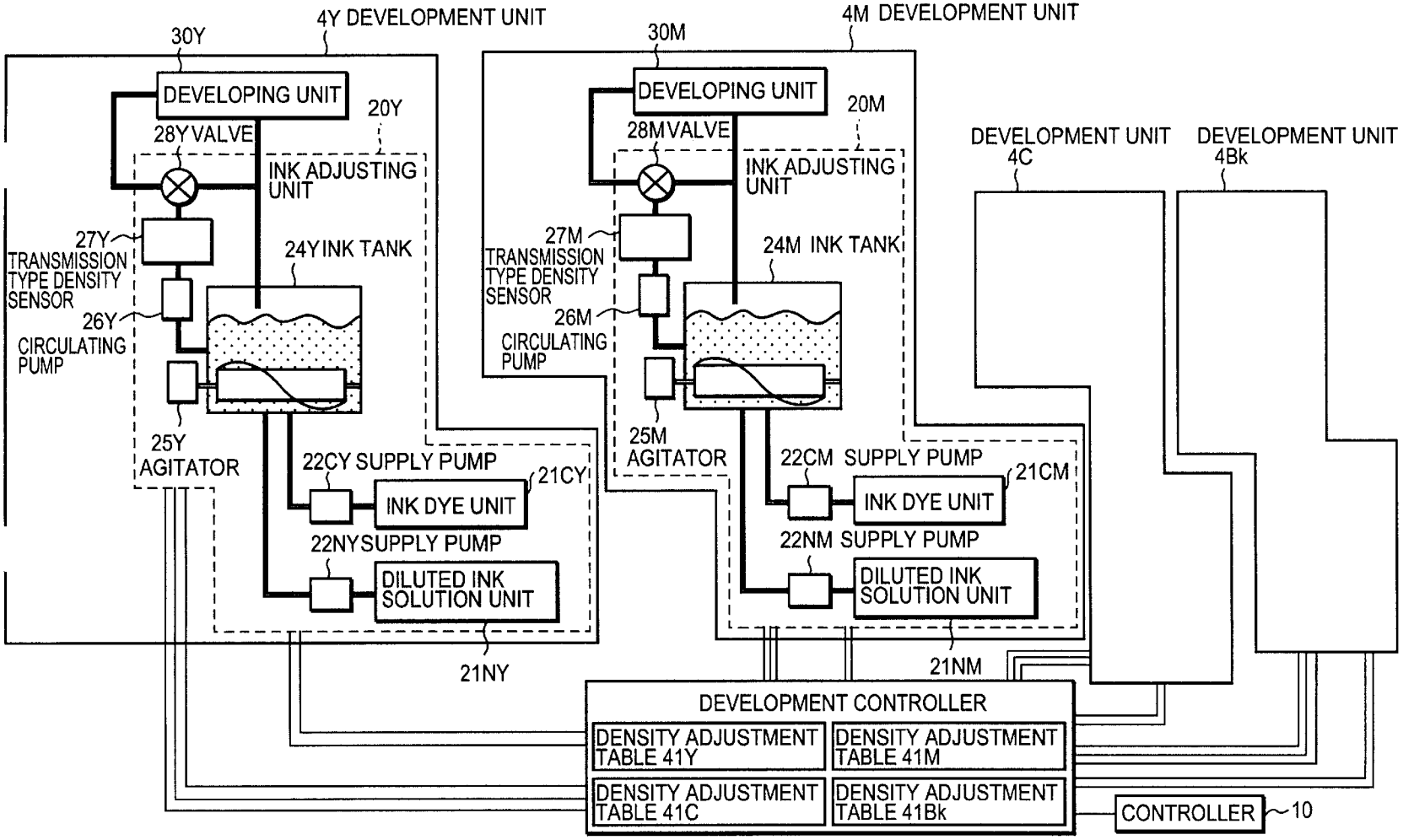
FIG. 7 is a block diagram showing the configuration of a development unit, a development controller, and a controller of the second embodiment.

FIG. 7 is a block diagram showing the configuration of the development units 4Y, 4M, 4C, and 4Bk, the development controller 40, and a controller 10. The development unit 4Y comprises an ink adjusting unit 20Y which controls the ink agitation operation, ink circulation operation, and the density adjustment operation and a developing unit 30Y which receives yellow ink from the ink adjusting unit 20Y and forms a yellow image on a photoconductor belt 1. The configuration of the ink adjusting unit 20Y is the same as that of the ink adjusting unit 20 described in the first embodiment. The configuration of the development units 4M, 4C, and 4Bk is similar to the configuration of the development unit 4Y except the ink color. That is, "Y" of the reference numeral 4Y is "M", "C", and Bk", respectively, in those development units. In FIG. 7, the components of the development units 4C and development unit 4Bk are omitted. In response to a request from the controller 10, the development controller 40 controls the ink adjusting units 20Y, 20M, 20C, and 20BK and developing units 30Y, 30M, 30C, and 3OBk. The development controller 40 comprises density adjustment tables 41Y, 41M, 41C, and 41Bk for the colors. The density adjustment tables 41Y, 41M, 41C, and 41Bk contain data for each color.

Figure 8:
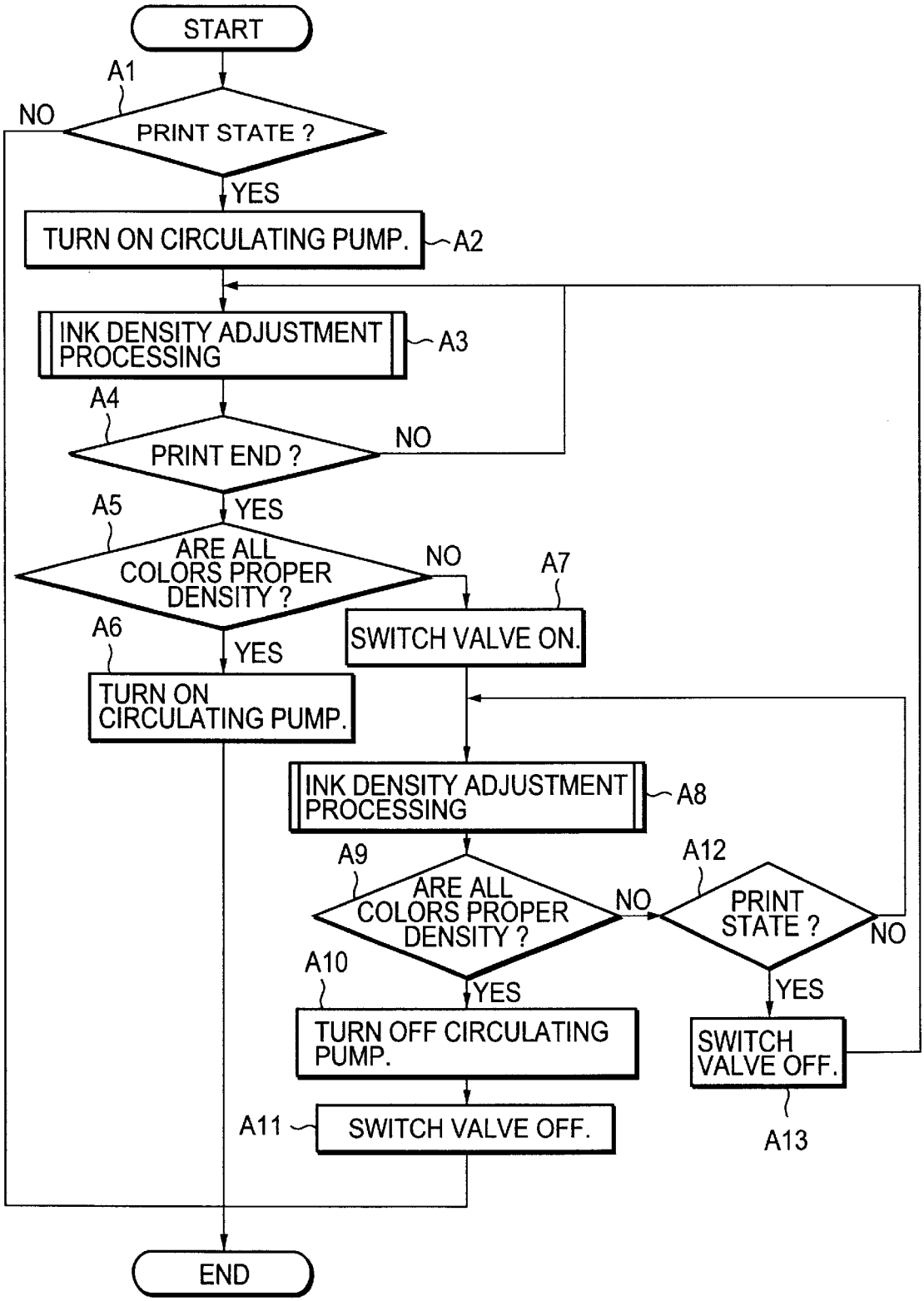
FIG. 8 is a flowchart showing the operation of the second embodiment.
Figure 9:
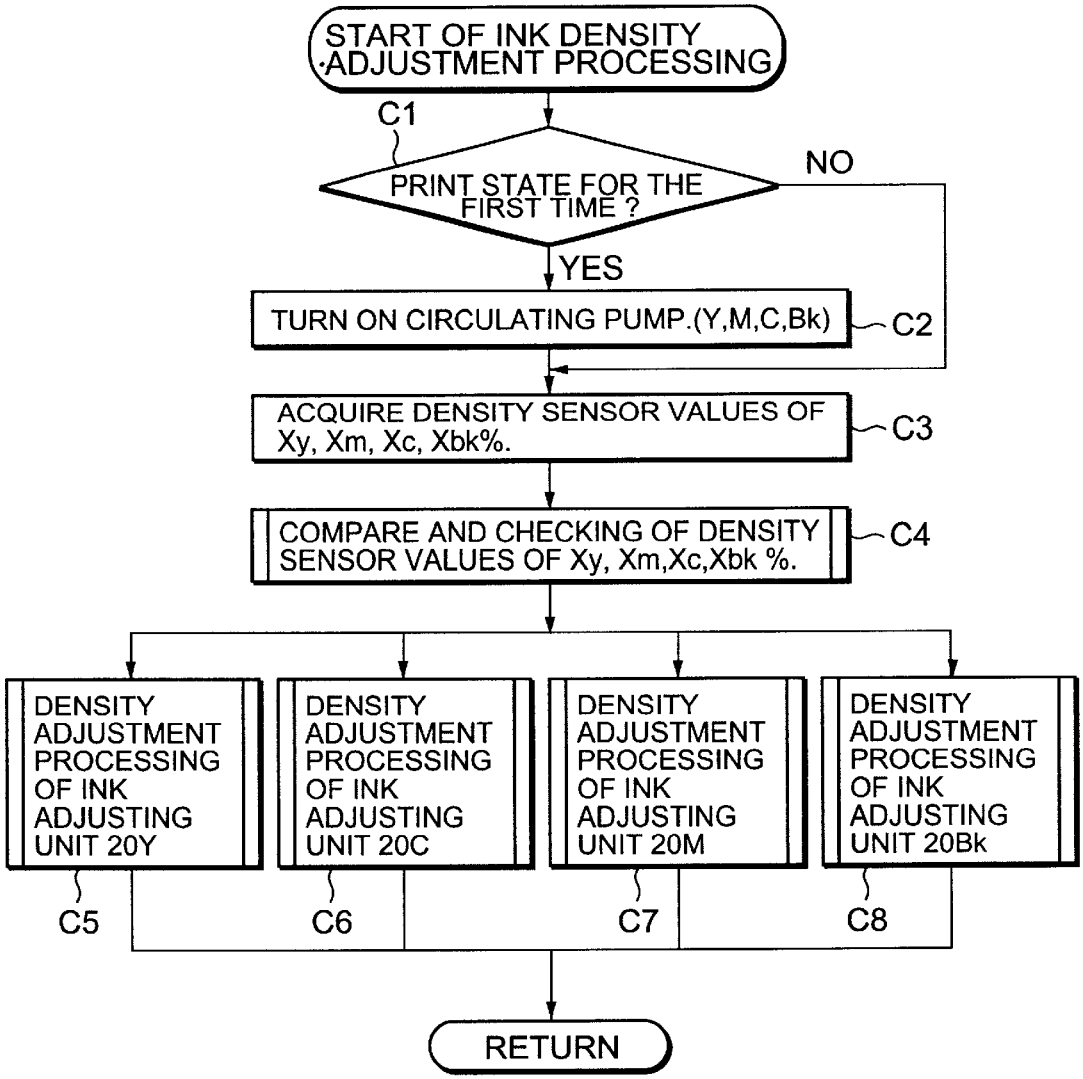
FIG. 9 is a flowchart showing the operation of the ink density adjustment processing of the second embodiment.

Next, the operation will be described. FIGS. 8 and 9 are flowcharts showing the operation of the second embodiment. This operation of the embodiment differs from that of the first embodiment, illustrated in FIGS. 3 and 4, in that density adjustment processing continues until all colors fall in the proper density range.

Figure 10:
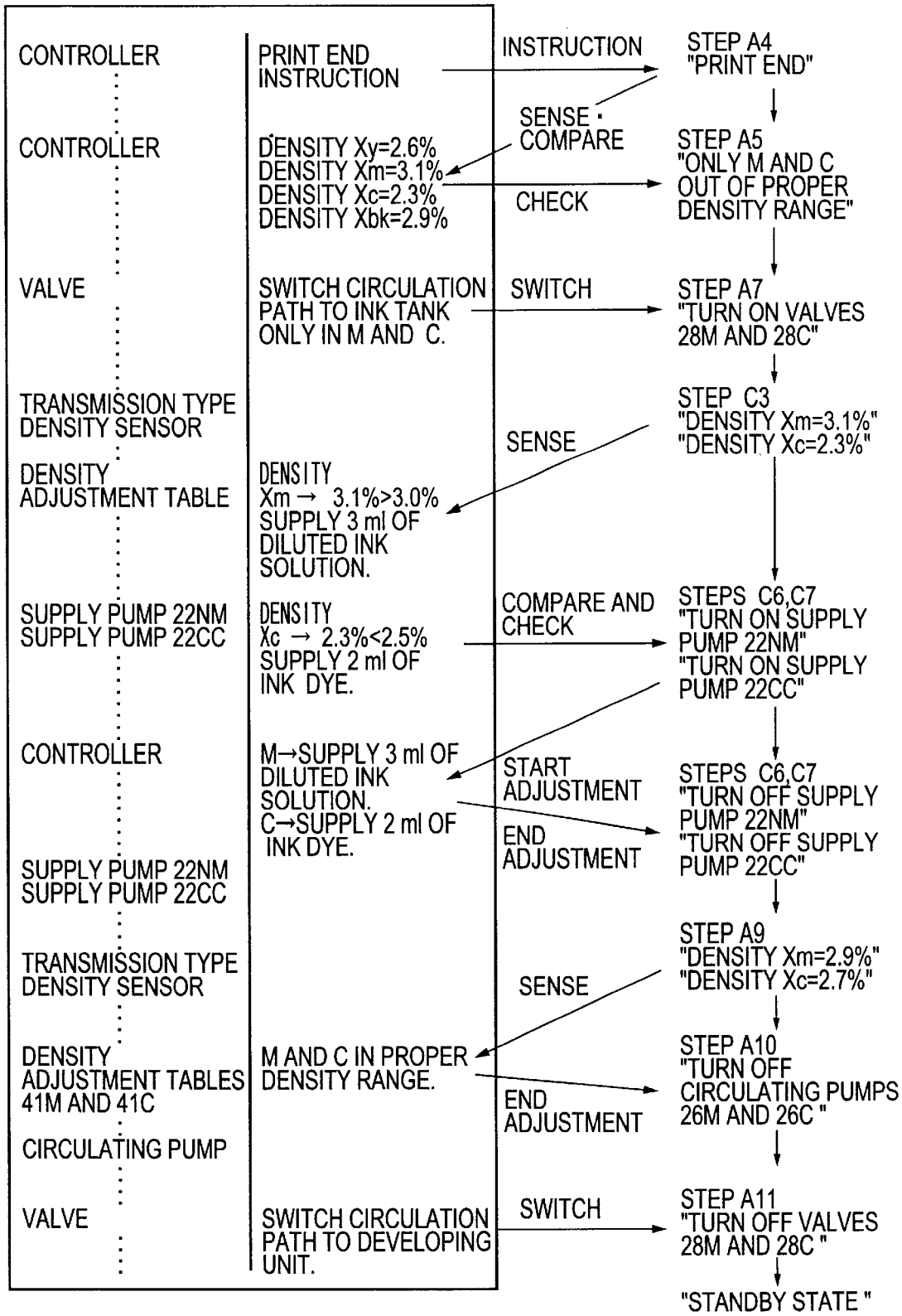
FIG. 10 is a diagram showing the operation of an example of the second embodiment.

Next, the operation of the embodiment will be described using an example. FIG. 10 is a diagram showing the operation of the example. Assume that the proper density of all colors ranges from 3.0% to 2.5%. At the end of step A4, the sensed density is 2.6% for Y, 3.1% for M, 2.3% for C, and 2.9% for Bk. These sensed densities are compared with the proper densities stored in the density adjustment tables 41Y, 41M, 41C, and 41Bk (step A5). Because the ink density adjusted by the ink adjusting units 20Y and 20Bk is within the proper range of ink density, these adjusting units stop circulation pumps 26Y and 26Bk and then enter the standby state. On the contrary, because the ink density adjusted by the ink adjusting units 20M and 20C is out of the proper range, these ink adjusting units turn on the valves 28M and 28C to switch the circulation paths (step A7). At this time, the ink stored in the supply paths from the valve 28M to the developing unit 30M and from the valve 28C to the developing unit 30C and in the developing units 30M and 30C is returned to the ink tanks 24M and 24C, respectively. In addition, the ink adjusting unit 20M supplies 3 ml of diluted ink solution, and the ink adjusting unit 20C supplies 2 ml of ink dye (steps C3–C7).

After finishing the adjustment, the density is checked again. The density is now 2.9% for M, and 2,7% for C. Because they are in the proper density range, the adjustment ends (step A9). Finally, the adjusting units stop circulation pumps 26M and 26C, turn off the valves 28M and 28C to allow the ink to flow into the developing units 30M and 30C, respectively, and then enter the standby state (steps A10–A11).

What is claimed is:

1. An ink density adjusting mechanism for use in an electrophotographic process using liquid ink, comprising:

a developing unit;

an ink tank;

a bypass for circulating said ink from a supply path for supplying said ink from said ink tank to said developing unit, to a return path for returning said ink from said developing unit to said ink tank, without supplying said ink to said developing unit;

a pump arranged for circulating said ink in said ink tank;

a valve arranged for switching a circulation path of said ink between a circulation path circulating said ink through said developing unit and a circulation path circulating said ink through said bypass; and a density sensor which senses a density of said ink circulated through said supply path or said return path.

2. The ink density adjusting mechanism according to claim 1, wherein, when said valve is switched to the circulation path bypassing said developing unit, the ink stored in an ink supply path between said valve and said developing unit and in said developing unit is returned to said ink tank.

3. The ink density adjusting mechanism according to claim 1, wherein said density sensor is provided on the circulation path between said ink tank and said valve.

4. The ink density adjusting mechanism according to claim 1, further comprising a development controller which causes said density sensor to sense the density of said ink when printing is finished and, if the density is not proper, switches said valve to the circulation path bypassing said developing unit to perform density adjustment processing of the ink.

5. The ink density adjusting mechanism according to claim 4, further comprising a table storing therein proper density range data on the ink and supply amount data on ink dye and on diluted ink solution, wherein said development controller compares the value sensed by said density sensor with the proper density node range data and, according to the supply data, supplies the ink dye or the diluted ink solution to said ink tank.

6. The ink density adjusting mechanism according to claim 5, wherein a plurality of sets of said developing unit, said ink tank, said pump, said valve, said density sensor, and said table are provided and wherein said development controller performs the density adjustment processing of a plurality of colors.

7. An electrophotographic apparatus using liquid ink, comprising an ink density adjusting mechanism which comprises:

a developing unit;

an ink tank;

a bypass for circulating said ink from a supply path for supplying said ink from said ink tank to said developing unit, to a return path for returning said ink from said developing unit to said ink tank, without supplying said ink to said developing unit;

a pump which circulates said ink in said ink tank;

a valve which switches a circulation path of said ink between a circulation path circulating said ink through said developing unit and a circulation path circulating said ink through said bypass; and a density sensor which senses a density of said ink circulated through said supply path or said return path.

8. The electrophotographic apparatus according to claim 7, wherein, when said valve is switched to the circulation path bypassing said developing unit, the ink stored in an ink supply path between said valve and said developing unit and in said developing unit is returned to said ink tank.

9. The electrophotographic apparatus according to claim 7, wherein said density sensor is provided on the circulation path between said ink tank and said valve.

10. The electrophotographic apparatus according to claim 7, further comprising a development controller which causes said density sensor to sense the density of said ink when printing is finished and, if the density is not proper, switches said valve to the circulation path bypassing said developing unit to perform density adjustment processing of the ink.

11. The electrophotographic apparatus according to claim 10, further comprising a table storing therein proper density range data on the ink and supply amount data on ink dye and on diluted ink solution, wherein said development controller compares the value sensed by said density sensor with the proper density node range data and, according to the supply data, supplies the ink dye or the diluted ink solution to said ink tank.

12. The electrophotographic apparatus according to claim 11, wherein a plurality of sets of said developing unit, said ink tank, said pump, said valve, said density sensor, and said table are provided and wherein said development controller performs the density adjustment processing of a plurality of colors.

* * * * *